US005906322A

United States Patent [19]

Hama

[11] Patent Number: 5,906,322

[45] Date of Patent: May 25, 1999

[54] CRUSHER AND MOVABLE SECTION FOR THE SAME

[75] Inventor: Tomio Hama, Ina, Japan

[73] Assignee: Kabushiki Kaisha Harmo Souken, Nagano-ken, Japan

[21] Appl. No.: 08/871,541

[22] Filed: Jun. 9, 1997

[30] Foreign Application Priority Data

Aug. 29, 1996 [JP] Japan ..... 8-228232
May 2, 1997 [JP] Japan ..... 9-114645

[51] Int. Cl.[6] ..... B02C 18/18

[52] U.S. Cl. ..... 241/152.2; 241/243; 241/267

[58] Field of Search ..... 241/152.2, 243, 241/101.2, 267, 268, 264, 285.3

[56] References Cited

U.S. PATENT DOCUMENTS

| | | |
|---|---|---|
| 31,027 | 1/1861 | Middleton . |
| 2,208,165 | 11/1940 | Sheahan . |
| 4,327,543 | 5/1982 | Currie et al. . |
| 4,848,679 | 7/1989 | Blumer . |
| 5,487,509 | 1/1996 | Hama . |

FOREIGN PATENT DOCUMENTS

| | | |
|---|---|---|
| 725353 | 5/1932 | France . |
| 61-3461 | 2/1986 | Japan . |
| 3-21352 | 1/1991 | Japan . |
| 7-39776 | 2/1995 | Japan . |
| 82212 | 8/1953 | Norway . |
| 189865 | 6/1937 | Switzerland . |

*Primary Examiner*—Mark Rosenbaum
*Attorney, Agent, or Firm*—Birch, Stewart, Kolasch & Birch, LLP

[57] ABSTRACT

In the crusher of the present invention, a rotary blade section has blades for roughly crushing a member to be crushed. A fixed blade section has a plurality of blades which are linearly arranged. A movable blade section has a plurality of blades which are linearly arranged and capable of engaging with the blades of the fixed blade section. The movable blade section is capable of swinging to move close to and away from the fixed blade section. A driving mechanism swings the movable blade section with the rotation of the rotary blade section. With this structure, the crushed members, which have been roughly crushed by the rotary blade section, are crushed into grains between the fixed blade section and the movable blade section.

24 Claims, 9 Drawing Sheets

CRUSHER AND MOVABLE SECTION FOR THE SAME

BACKGROUND OF THE INVENTION

The present invention relates to a crusher and a movable blade section for the same, more precisely the invention relates to a crusher, which is capable of crushing scrapped members, e.g., resin, rubber, into grains having prescribed size, and a movable blade section for the crusher.

The inventor of the present invention has invented a crusher, which is capable of crushing scrapped resin into grains having a prescribed size for reuse. The crusher has been disclosed in Japanese Patent Kokai Gazette No. 7-39776. Before the inventor invented said crusher, crushers had rotary blades for crushing scrapped members. On the other hand, the crusher, which has been disclosed in said gazette, has a fixed blade section, which has a plurality of shearing blades, and a movable blade section , which has a plurality of shearing blades engaging with the shearing blades of the fixed blade section. The movable blade section is linearly reciprocatively moved to shear or crush the scrapped members into grains.

The crusher disclosed in said gazette is shown in FIG. 13. The crusher shown in FIG. 13 has a rotary blade section 10 and fixed blades 12. Members to be crushed, e.g., scrapped resin, are roughly crushed between the rotary blade section 10 and the fixed blades 12. The rotary blade section 10 is provided in the vicinity of an upper opening section of a body proper 14; a fixed blade section 20*a* and a movable blade section 20*b,* which are capable of crushing the members, which have been roughly crushed between the rotary blade section 10 and the fixed blades 12, into grains, are provided in a lower part of the body proper 14. The inner space of the body proper 14 is gradually made narrower toward the blade sections 20*a* and 20*b,* so that the members, which have been roughly crushed between the rotary blade section 10 and the fixed blades 12, can be securely introduced onto engaging portions of the blades of the fixed blade section 20*a* and the movable blade section 20*b*.

The fixed blade section 20*a* and the movable blade section 20*b* are formed into block shapes. They are diagonally provided to introduce the members roughly crushed toward the engaging section thereof. The members roughly crushed are further crushed into grains by slidably engaging the movable blade section 20*b* with a lower face of the fixed blade section 20*a*. The fixed blade section 20*a* and the movable blade section 20*b* are shown in FIG. 14. They shear (crush) the members twice within one stroke of the movable blade section 20*b*. So the fixed blade section 20*a* has first blades 22 and second blades 24; the movable blade section 20*b* has third blades 26 and the fourth blades 28.

The members are firstly sheared between the first blades 22 and the third blades 26; they are secondly sheared between the second blades 24 and the fourth blades 28. The blades 22, 24, 26 and 28 are linearly arranged at the regular intervals as shown. The intervals define grain size of the crushed members, which have been crushed by the fixed blade section 20*a* and the movable blade section 20*b*. Inner side faces of projected parts 29 of the first blades 22 act as blade faces; edges of concave sections of the second blade 22 act as blade faces.

FIG. 15A shows the member 30 not crushed; FIG. 15B shows the member 30 which has been firstly sheared between the first blades 22 and the third blades 26. The first shearing is executed between the first blades 22 and the third blades 26 as if they bite the member 30. When the member 30 is firstly sheared, parts corresponding to the third blades 26 are removed from the member 30, so that the member 30 is formed like a comb. Projected sections of the member 30, which have been firstly sheared, are removed by the second shearing, so that the member 30 is formed into a columnar stick.

In the first shearing, the removed parts are formed into grains and discharged by the downward movement of the third blades 26; in the second shearing, the removed parts are also formed into grains and discharged through discharging holes 28*a* of the fourth blades 28. The discharging holes 28*a* are opened in lower faces of the movable blade section 20*b,* and the removed grains are discharged from the opening sections thereof.

With the above described structure, the crusher is capable of crushing (shearing) the members to be crushed into grains with fixed size. In the case of crushing scrapped resin, the resin grains can be reused.

However, the above described crusher has the following disadvantages.

The members to be crushed are roughly crushed by the rotary blade section 10 in the body proper 14, then they fall onto the engaging sections of the fixed blade section 20*a* and the movable blade section 20*b* and are further crushed into grains. But some grains stay on the engaging sections, so that they are not crushed by the fixed blade section 20*a* and the movable blade section 20*b*. Especially, scrapped resin is apt to stay thereon by static electricity.

In the above described crusher, a motor for rotating the blades of the rotary blade section 10 drives a cam mechanism for reciprocatively moving the movable blade section 20*b*. In FIG. 13, a cam plate 34 holds the movable blade section 20*b*. An eccentric roller 38 engages with a window section 36 of the cam plate 34. The eccentric roller 38 is rotated by the motor to reciprocatively move the cam plate 34. By employing such a complex cam mechanism, noise and vibration are generated in the crusher.

In the above described crusher, the fixed blade section 20*a* and the movable blade section 20*b* have a plurality of blades, and the blades are arranged with intervals, which are defined according to grain size, so each interval of adjacent blades is 3–4 mm. The blades with said intervals are made by, for example, electrical discharge machining, but it is difficult to make the blades by electrical discharge machining, and the machining cost is high.

SUMMARY OF THE INVENTION

An object of the present invention is to provide a crusher having a simple structure and compact size.

Another object of the present invention is to provide a crusher in which members to be crushed do not stay in crushing portions.

Another object of the present invention is to provide a movable blade section for said crushers, which can be made easily.

To achieve the object, the crusher of the present invention comprises:

a rotary blade section having blades for roughly crushing a member to be crushed;

a fixed blade section having a plurality of blades which are linearly arranged;

a movable blade section having a plurality of blades which are linearly arranged and capable of engaging with the blades of the fixed blade section, the movable blade section being capable of swinging to move close to and away from the fixed blade section; and a driving mechanism for swinging the movable blade section with the rotation of the rotary blade section, whereby the crushed members, which have been roughly crushed by the rotary blade section, are crushed into grains between the fixed blade section and the movable blade section.

With this structure, noise and vibration in the crusher can be limited, the structure of the crusher can be simpler so that the compact crusher, which will have few mechanical troubles, can be provided.

In the crusher, the driving mechanism may include:

a motor for rotating the rotary blade section; and a motion converting mechanism for converting the rotary motion of the motor into the swing motion of the movable blade section.

In the crusher, the movable blade section may include:

a shaft coaxially extending from the movable blade; and a swinging arm being attached to the shaft, and the motion converting mechanism may include:

an eccentric pin being moved along a circular orbit by the motor; and a link connecting the eccentric pin with the swinging arm.

In the crusher, blade chips of the rotary blade section may be moved along tracks, which are close to engaging portions of the blades of the fixed blade section and the movable blade section, whereby the crushed members, which stay on the engaging portions, can be raked out therefrom by the blades of the rotary blade section.

With this structure, the members can crush efficiently.

In the crusher, the blades of the fixed blade section may be first blades and second blades, and the blades of the movable blade section may be third blades and fourth blades, whereby the crushed members are primarily sheared between the first blades and the third blade, and the crushed members, which have been primarily sheared, are secondly sheared between the second blades and the fourth blades in one stroke of the movable blade section.

In the crusher, the movable blade section may include:

a columnar blade base; and a plurality of the blades being linearly arranged on an outer circumferential face of the columnar blade base in the axial direction thereof.

With this structure, the crushing efficiency can be further improved.

The crusher of the present invention may further comprise a body proper being formed into a box whose upper face is opened, wherein side walls of the body proper may be formed by: a fixed side plate; a holding member for holding the driving mechanism, the holding member being arranged to face the fixed side plate; and a pair of movable side plates, which can be opened and closed, and which are arranged to face each other, and the rotary blade section and the movable blade may be pivotably spanned, in parallel, between the fixed side plate and the holding member.

In the movable blade section of the present invention, which is applied to said crusher, each blade has the third blade and the fourth blade, and a plurality of the blades are arranged side by side on the blade base.

In the movable blade section, a circular guide groove, through which grains sheared by the fixed blade section and the movable blade section pass, may be formed on a side face of each blade. With this structure, the crushing (shearing) can be executed smoothly.

In the movable blade section, each blade may be made by metal injection molding. So the blades having complex structures and enough durability can be made easily.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
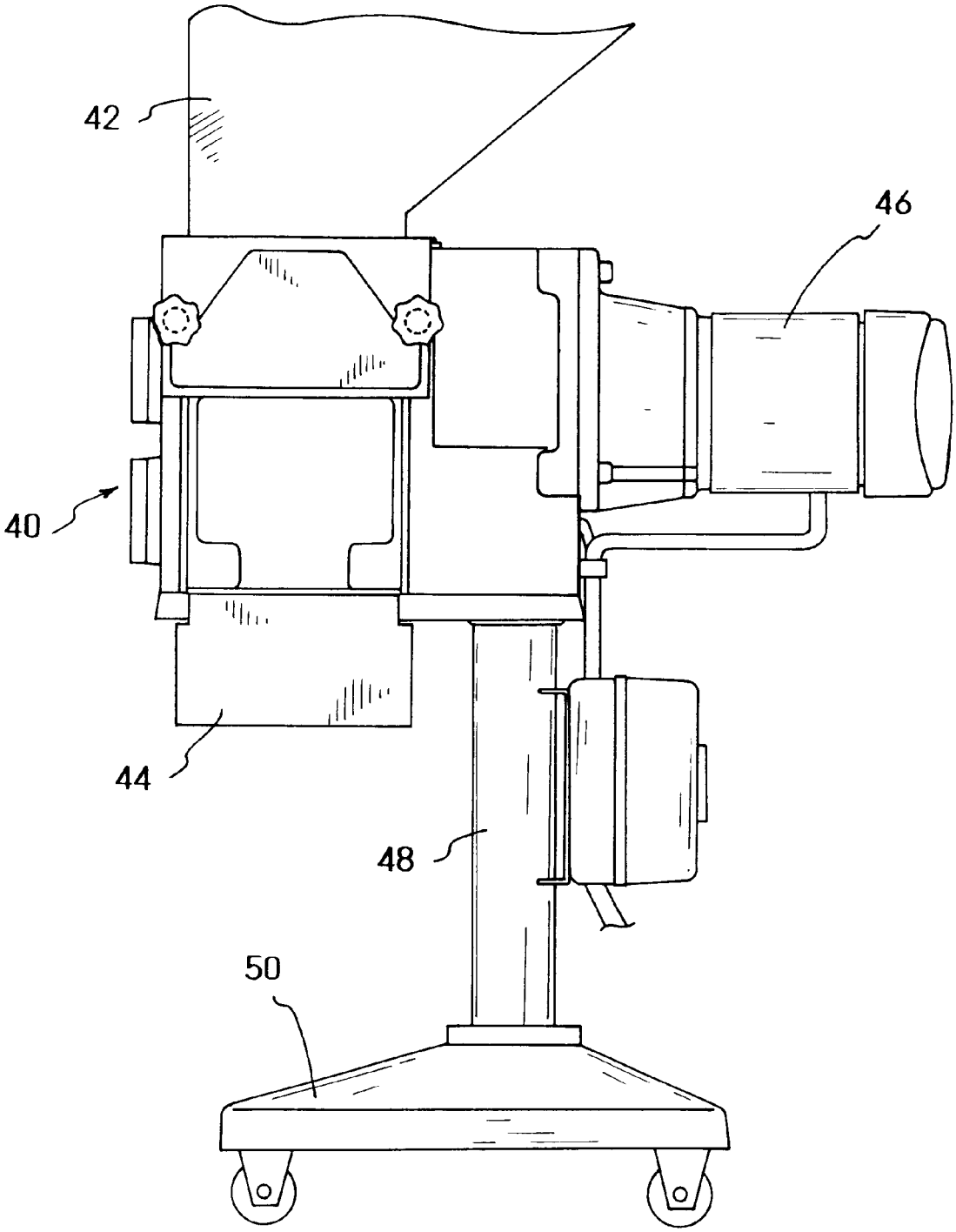
FIG. 1 is a front view of a crusher of an embodiment of the present invention.

FIG. 1 is the front view of the crusher of the present embodiment. A hopper 42 for introducing members to be crushed into a body proper 40. A shooter 44 is attached to a lower part of the body proper 40. Namely, the members to be crushed are put into the hopper 42; the crushed members are downwardly discharged from the body proper 40 via the shooter 44. A bag for collecting the crushed members may be attached to a lower end of the shooter 44. A motor 46 drives the crusher. The body proper 40 is supported by a supporting pillar 48 and a foot section 50.

Figure 2:
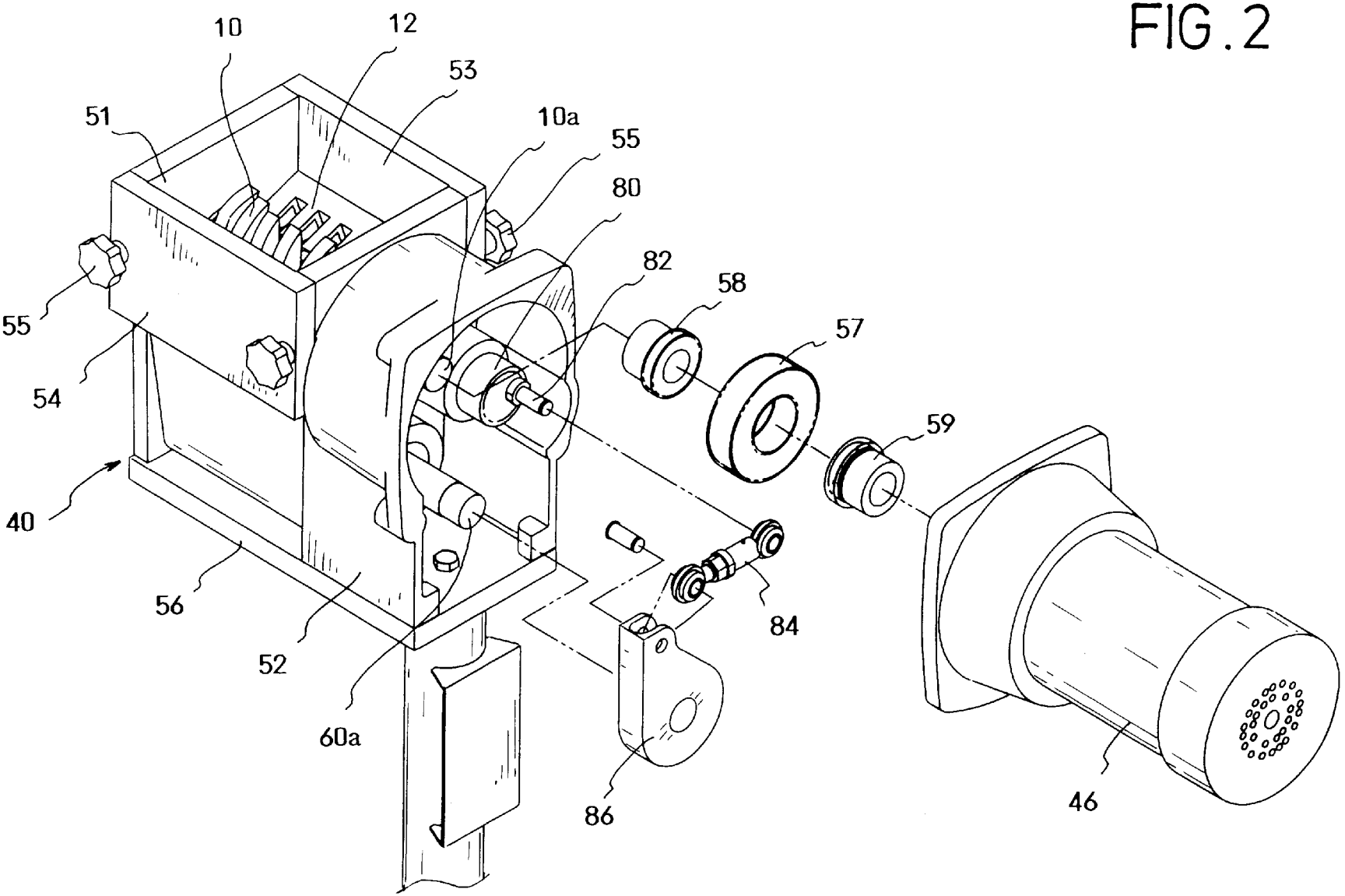
FIG. 2 is an exploded perspective view of the crusher with a motor.

An inner structure of the body proper 40 and an attaching mechanism of the motor 46 are shown in FIG. 2. A rotary blade section 10 for roughly crushing the members is provided together with blade sections (a fixed blade section 70 and the movable blade section 60) for further crushing the members into grains in the body proper 40 as well as the conventional crusher. The blade sections 60 and 70 for further crushing the members are provided under the rotary blade section 10 as well. The action and function of the blade sections 60 and 70 are equal to those of the conventional crusher. But, in the present embodiment, the motor 46 not only rotates the rotary blade section 10 but also swings the movable blade section 60.

In the conventional crusher, the movable blade section is reciprocatively moved by the cam mechanism; in the present embodiment, the movable blade section 60 is pivotably held and swung about its own axis. In the present embodiment, blades of the movable blade section 60 slidably engage with blades of the fixed blade section 70, so that the members, which have been roughly crushed by the rotary blade section 10, can be crushed (sheared) into grains.

Figure 3:
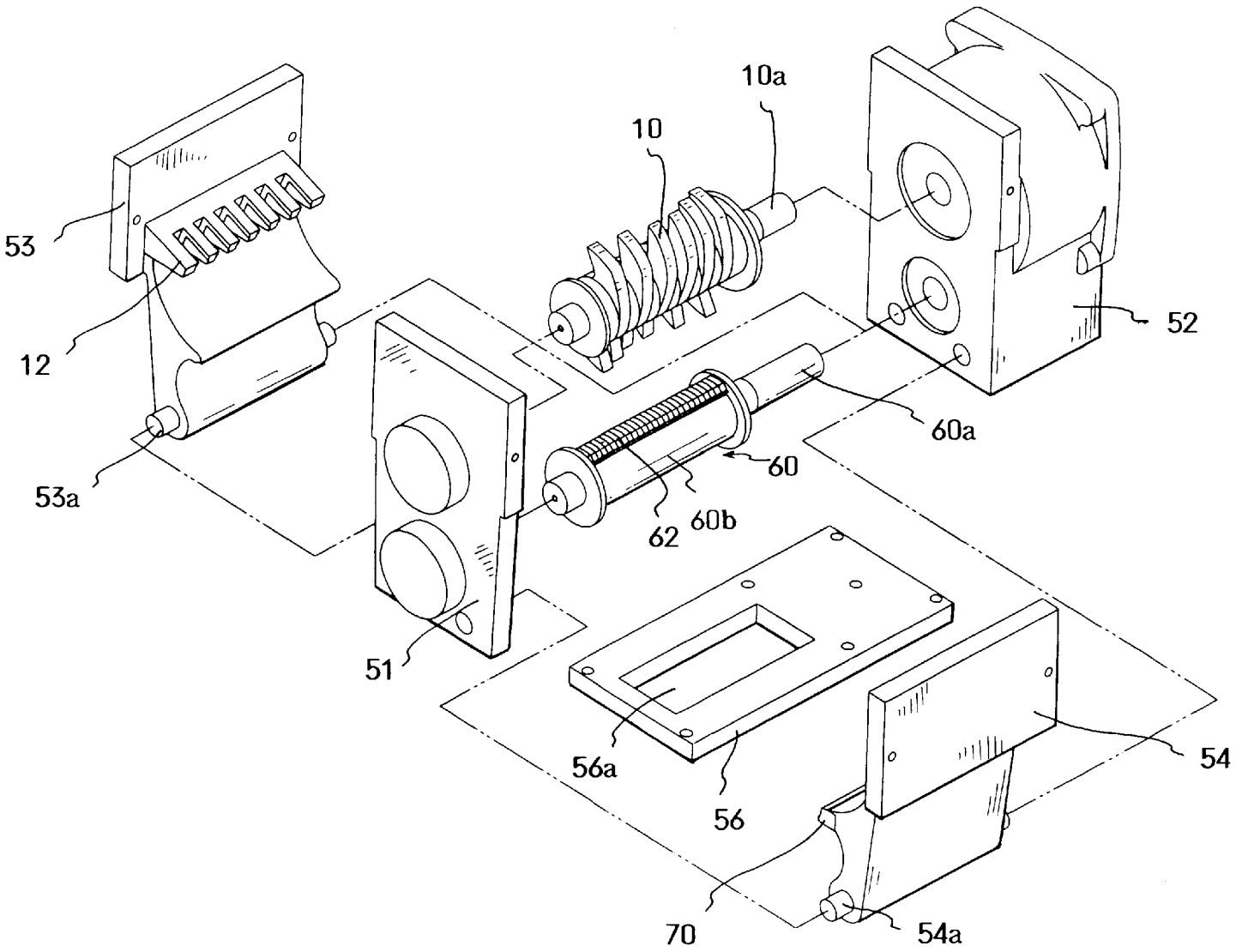
FIG. 3 is an exploded perspective view of a rotary blade section and a movable blade section.

FIG. 3 is the exploded perspective view of the rotary blade section 10 and the movable blade section 60 in the body proper 40. A plurality of blades are fixed on a shaft 10*a* of the rotary blade section 10. The movable blade section 60 includes a columnar blade base 60*b* and a plurality of small blades 62, which are linearly arranged on an outer circumferential face of the columnar blade base 62*b* in the axial direction, and which are mutually arranged in parallel. A plurality of blades are fixed on a shaft 10*a* of the rotary blade section 10.

The rotary blade section 10 and the movable blade section 60 are spanned between a side plate 51 and a holding member 52, which holds the motor 46, of the body proper 40. The shaft 10 and a shaft 60*a* are arranged in parallel. The rotary blade section 10 is provided on an upper side of the movable blade section 60.

The body proper 40 further includes movable side plates 53 and 54, which are arranged to face each other. Fixed blades 12, which are capable of engaging with the blades of the rotary blade section 10, are fixed to the movable side plate 53; the fixed blade section 70 is fixed to the movable side plate 54.

The movable side plates 53 and 54 are capable of respectively turning about axes 53*a* and 54*a*. With this structure, side faces of the body proper 40 can be opened and closed by turning the movable side plates 53 and 54. By opening the side faces of the body proper 40, inner parts of the crusher can be cleaned, and maintenance of inner mechanisms can be executed. As shown in FIG. 2, knobs 55 are attached to the movable side plates 53 and 54, so the movable side plates 53 and 54 can be manually moved. As shown in FIG. 3, a bottom plate 56 is fixed to a lower end of the body proper 40, and the bottom plate 56 has a discharging hole 56*a*, through which the crushed members are discharged downwardly.

In the present embodiment, the rotary blade section 10 and the movable blade section 60 are driven by one motor 46.

As shown in FIG. 2, an output shaft of the motor 46 is connected with the shaft 10*a* of the rotary blade section 10, so that the motor 46 rotates the rotary blade section 10. The output shaft of the motor 46 is also connected with the shaft 60*a* of the movable blade section 60, so that the motor 46 swings the movable blade section 60 about the shaft 60*a*. The output shaft of the motor 46 is connected with the movable blade section 60 by a connecting gear 57. The output shaft of the motor 46 and the shaft 10*a* of the rotary blade section 10 are mutually connected by connecting sleeves 58 and 59. Gears are formed on outer circumferential faces of the connecting sleeves 58 and 59, and said gears are engaged with gears formed on an inner circumferential face of the connecting gear 57, which is formed into a donut shape, so that the output shaft of the motor 46 and the connecting gear 57 are mutually connected.

The connecting gear 57 and the movable blade section 60 are mutually connected by a motion converting mechanism, which converts the rotary motion of the motor 46 into the swing motion of the movable blade section 60. In the motion converting mechanism of the present embodiment, an intermediate gear 80 is engaged with the connecting gear 57, and an eccentric pin 82 of the intermediate gear 80, which is eccentrically provided in the gear 80, is pivotably connected with a part of a swinging arm 86, which is fixed to and extends from the shaft 60*a* of the movable blade section 60, by a link piece 84.

Figure 4:
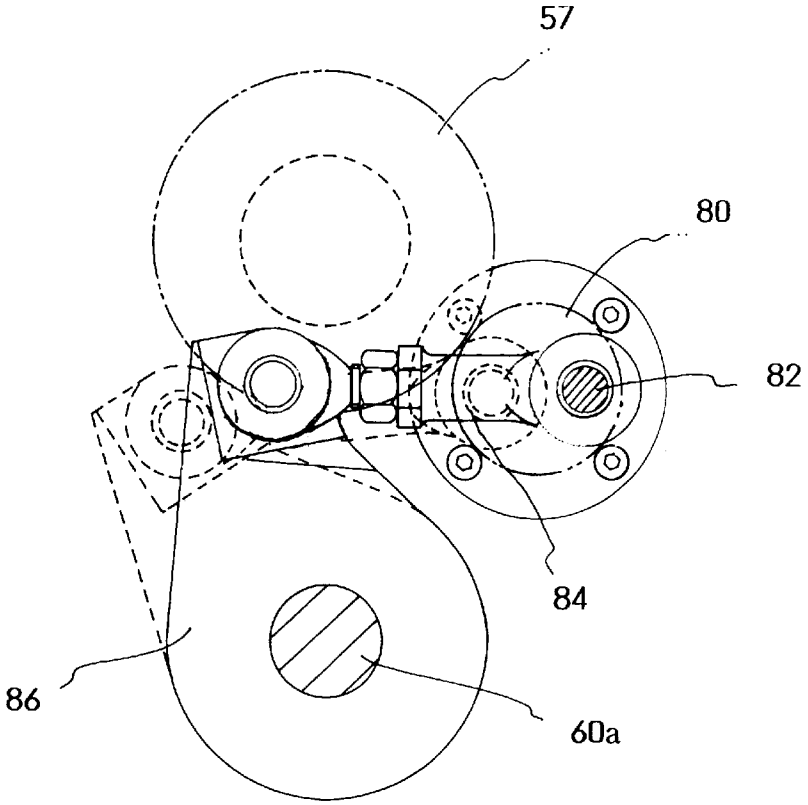
FIG. 4 is an explanation view showing the relationship between the motor and the movable blade section.

FIG. 4 shows the action of the motion converting mechanism, which swings the movable blade section 60. Rotary torque of the connecting gear 57 is transmitted to the intermediate gear 80, so that the eccentric pin 82 is moved along a circular orbit. The link piece 84 converts the circular movement of the eccentric pin 82 into the swing movement of the swinging arm 86, so that the movable blade section 60 is swung.

In the present embodiment, the gear ratio between the connecting gear 57 and the intermediate gear 80 is 2:1, so that the movable blade section 60 is reciprocatively swung twice while the connecting gear 57 rotates once. Namely, the movable blade section 60 crushes (shears) the members, which have been roughly crushed by the rotary blade section 10, into the grains once when the blades of the rotary blade section 10 pass near the movable blade section 60.

By converting the rotary movement of the motor 46 into the swing movement of the movable blade section 60, the movable blade section 60 cannot execute true linear motion, but a mechanism for moving the movable blade section 60 can be very simple, so that the movable blade section 60 can be moved very smoothly. By the smooth movement, noise and vibration can be restricted. Further, the structure of the mechanism is very simple, so the crusher can be compact in size.

Figure 5:
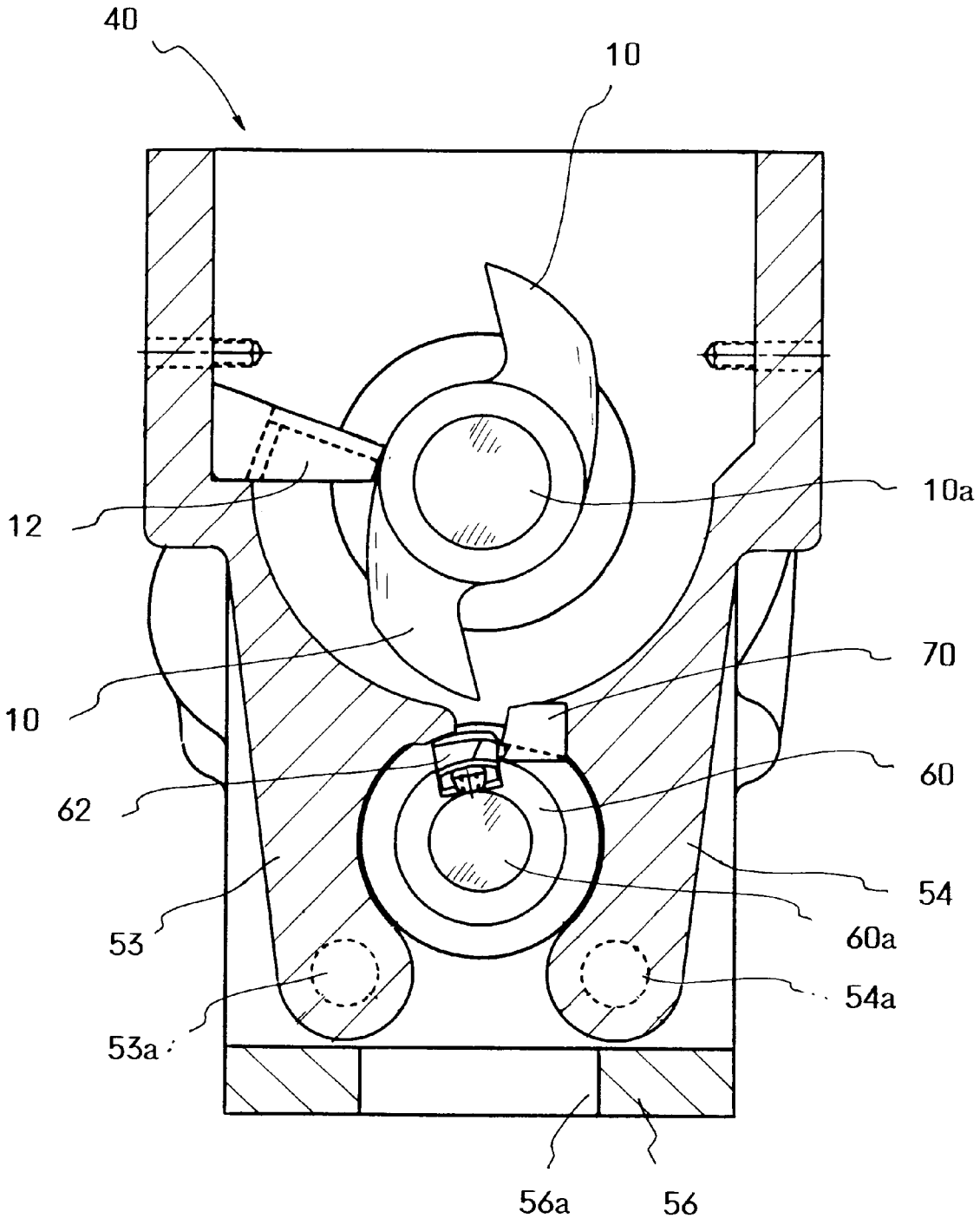
FIG. 5 is a sectional view showing the relationship between a fixed blade section and the movable blade section.

Arrangement of the rotary blade section 10, the movable blade section 60, the fixed blade section 70, etc. is shown in FIG. 5. As described above, the rotary blade section 10 and the movable blade section 60 are arranged in parallel, and the rotary blade section 10 is provided above the movable blade section 60 in the body proper 40. In the present embodiment, blade chips of the rotary blade section 10 are moved along tracks, which are close to engaging portions of the blades of the fixed blade section 70 and the movable blade section 60, whereby the crushed members, which stay on the engaging portions, can be upwardly raked therefrom by the blades of the rotary blade section 10.

In the conventional crusher, the roughly crushed members often stay on the engaging portions of the fixed blade section and the movable blade section, so they cannot be crushed into the grains. But, in the present embodiment, the blade chips of the rotary blade section 10 are moved along the tracks close to said engaging portions. So the roughly crushed members can be securely introduced to the engaging portions. Some members, which cannot be crushed by the movable blade section 60 and the fixed blade section 70 due to their sizes, are raked upwardly and roughly crushed again between the rotary blade section 10 and the fixed blades 12, then they falls onto said engaging portions to crush into grains.

The movable blade section 60 is swung along an arched track, so shapes of the blades 62 are designed on the basis of the arched track in order to shear the members as well as the conventional crusher. In the crusher of the present embodiment too, the members to be crushed are put into the body proper 40 via the hopper 42. The members are roughly crushed by the rotary blade section 10 and the fixed blades 12. The members, which have been roughly crushed, fall onto the engaging portions of the movable blade section 60 and the fixed blade section 70, then they are crushed or sheared, by the movable blade section 60 and the fixed blade section 70, into the grains. The grains are discharged through the discharging hole 56*a* of the bottom plate 56 of the body proper 40. The crushing (shearing) action by the movable blade section 60 and the fixed blade section 70 is equal to that of the conventional crusher.

Figure 6:
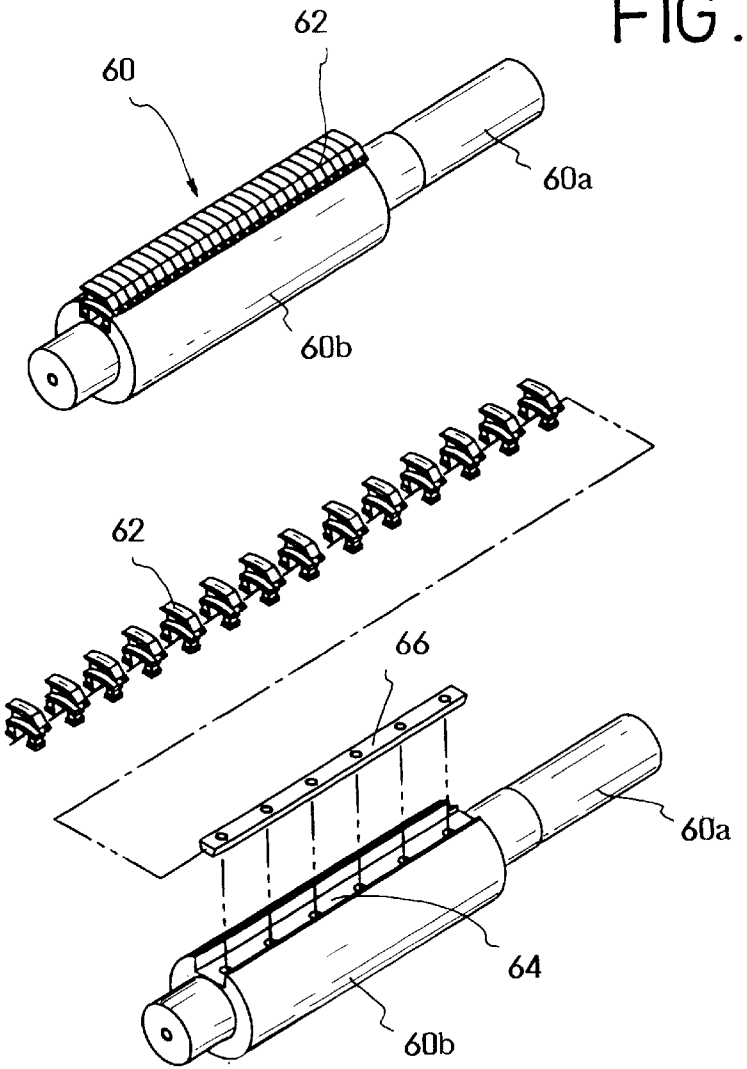
FIG. 6 is an exploded perspective view of the movable blade section.

The structure of the movable blade section 60 of the present embodiment is shown in FIG. 6.

The width of each blade 62 of the movable blade section 60 is about 3–4 mm for crushing the members into the grains. As described above, the blades 62 must be formed into curved shapes because their shapes are designed on the basis of the arched track of the movable blade section 60, so it is difficult for the blades 62 to form said shapes by usual machining, e.g., electrical discharge machining.

In the present embodiment, a plurality of blades 62 are linearly arranged in the axial direction of the movable blade section 60. The blades 62 are made in a respective machining step, and they are combined and attached onto the blade base 60*b*. With this process, the movable blade section 60 can be made easily and correctly.

Figure 7A:
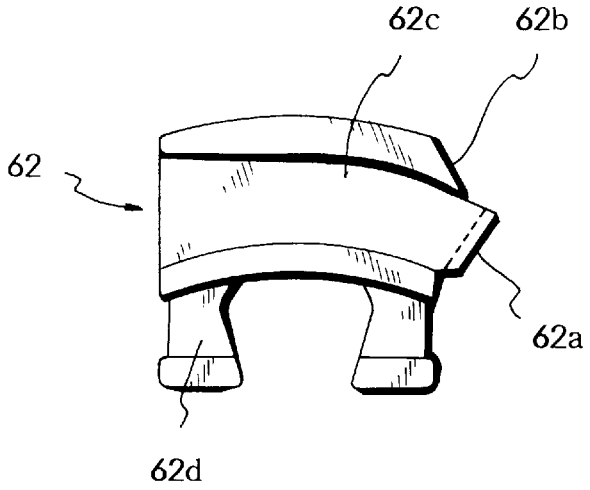
FIG. 7A is a side view of a blade.
Figure 7B:
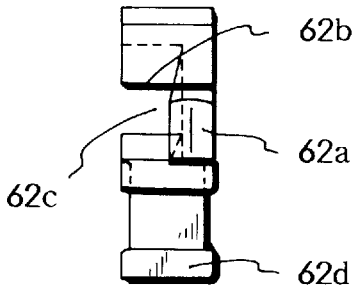
FIG. 7B is a front view of the blade.
Figure 13:
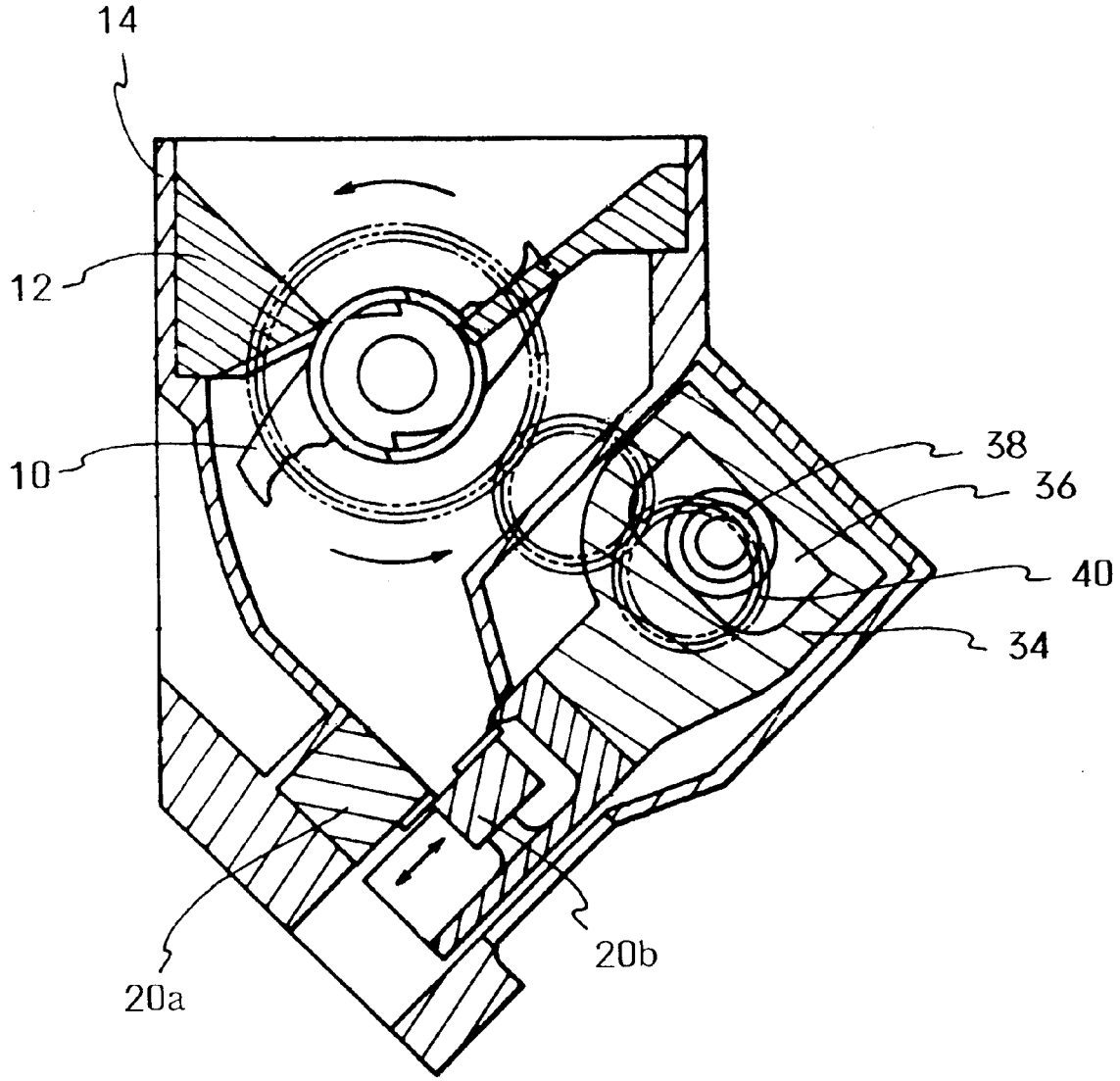
FIG. 13 is a sectional view of a main part of the conventional crusher.
Figure 14:
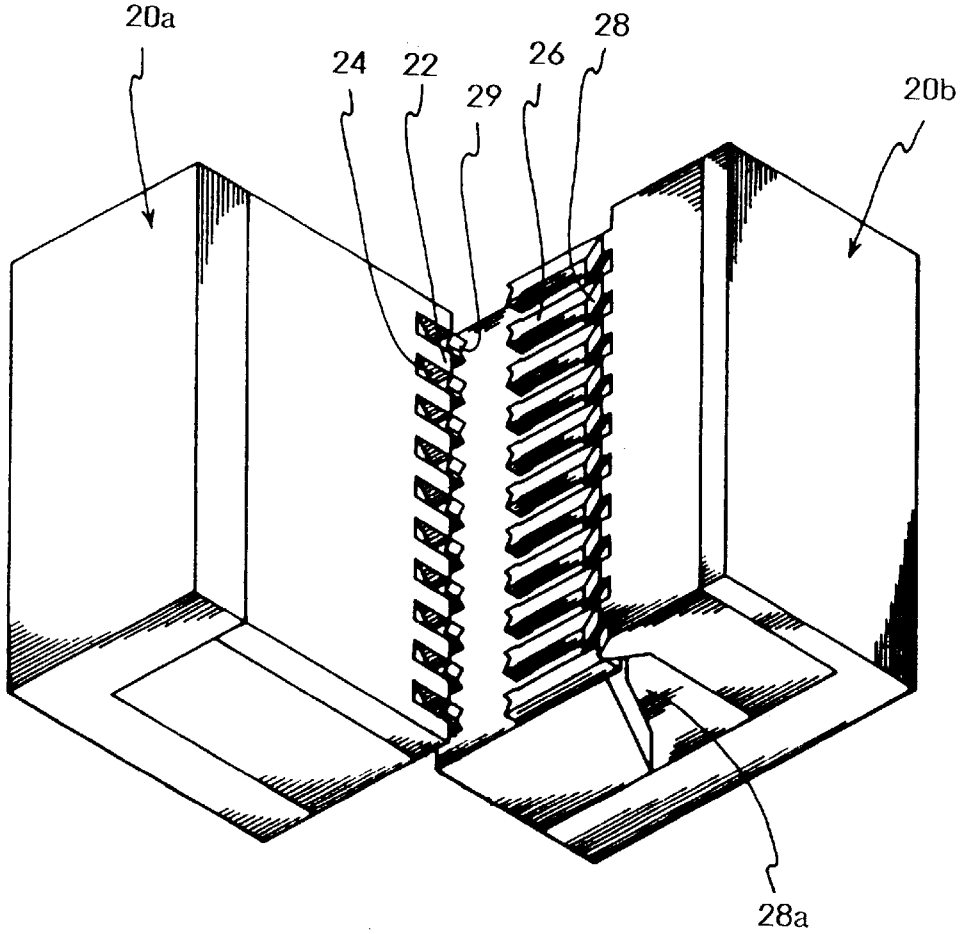
FIG. 14 is an explanation view of a fixed blade section and a movable blade section of the conventional crusher.
Figure 15A:
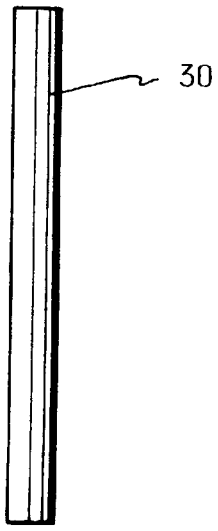
FIG. 15A is a front view of a member to be crushed, which is not crushed.
Figure 15B:
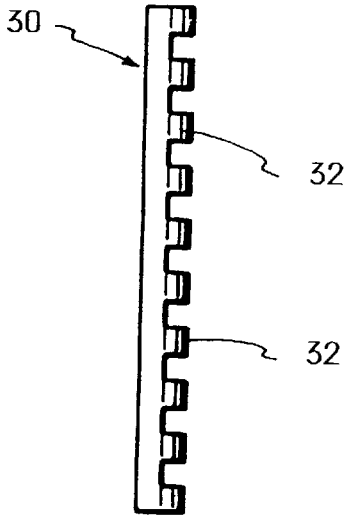
FIG. 15B is a front view of the member to be crushed, which has been firstly sheared.

FIG. 7A is the side view of the blade 62; FIG. 7B is the front view of the blade 62. The blade 62 has a third blade 62*a* and a fourth blade 62*b* as well as the conventional crusher (see FIG. 13). The third blade 62*a* is used for the primary shearing; the fourth blade 62*b* is used for the secondary shearing.

In the primary shearing, the roughly crushed members are downwardly ejected by the third blades 62*a;* in the secondary shearing, said members sheared into the grains are ejected toward the rear sides of the fourth blades 62*b* by second blades 70*b* of the fixed blade section 70. To eject the grains, guide holes for introducing the grains are required. Each blade 62 has a groove 62*c,* which is formed in the transverse direction of the blade 62, in a side face. When a plurality of the blades 62 are arranged side by side to mutually contact (see FIG. 6), the grooves 62*c* act as the guide holes. The movable blade section 62 is swung along the arched track, so the blades 62 of the movable blade section 60 are slidably engaged with the blades of the fixed blade section 70. Thus, the groove 62*c* of the blade 62 is formed into an arched shape. With this structure, the blades 62 of the movable blade section 60 are slidably engaged with the blades of the fixed blade section 70 with the swing motion of the movable blade section 60.

In FIG. 6, a plurality of the blades 62 are mutual contact, and they are fixed on the blade base 60*b*. The blade base 60*b* has an attaching groove 64, which are formed in an outer circumferential face and extends in the axial direction. An attaching plate 66 is fixed in the attaching groove 64. Each blade 62 has engaging sections 62*d,* which are capable of engaging with the attaching plate 66. Namely, the blades 62 are engaged with the attaching plate 66, then the attaching plate 66 is fixed in the attaching groove 64 of the blade base 60*b* by bolts, so that a plurality of the blades 62 are linearly arranged in the axial direction of the movable blade section 60.

The shape of the blade 62 is more complex than that of the movable blade section of the conventional crusher. The blades 62 may be made by the electrical discharge machining. To efficiently make the blades 62, the blades 62 may be made by metal injection molding. By the metal injection molding, the complex blades 62 can be made easily. In the case of crushing scrapped resin, required durability of the blades 62 is not so great, so the blades 62 made by the metal injection molding can be employed.

The blades 62 are respectively made, so each blade 62 has been checked and passes product examination. Namely, all the blades 62 have enough durability, and the movable blade section 60 must have reliability. The size of the movable blade section 60 is designed on the basis of required crushing capability. The blades 62 can be applied to other movable blade sections having different sizes by changing the number of the blades 62. To increase processing capability, a large movable blade section having many blades 62 may be employed.

Figure 8:
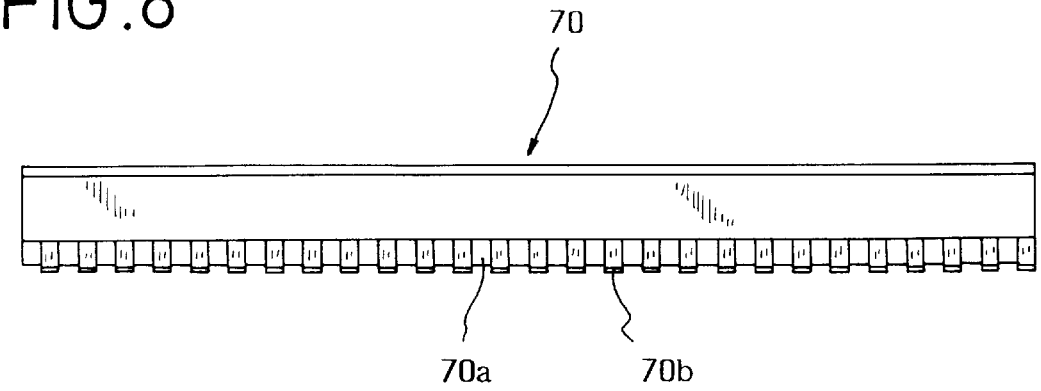
FIG. 8 is a front view of the fixed blade section.
Figure 9:
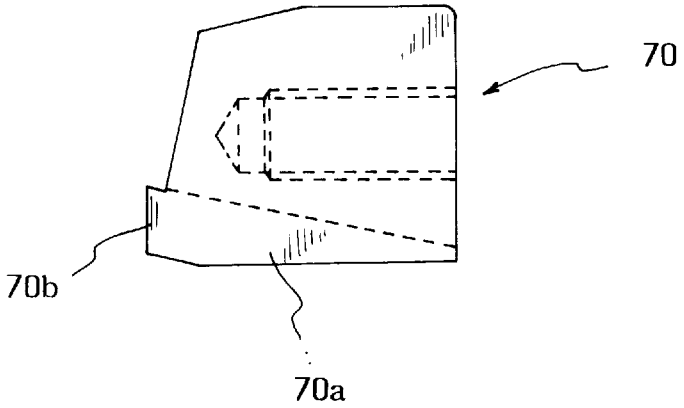
FIG. 9 is a side view of the fixed blade section.

FIG. 8 is the front view of the fixed blade section 70, which engages with the movable blade section 60; FIG. 9 is the side view thereof. The fixed blade section 70 has first blades 70*a* and second blades 70*b,* which engage with the blades 62 of the movable blade section 60 to crush (shear) the roughly crushed members. The first blades 70*a* engage with the third blades 62*a* of the movable blade section 60, and they look like cavities in the front view; the second blades 70*b* engage with the fourth blades 62*b* of the movable blade section 60, and they project forward in the side view. Note that, the first blades 70*a* and the second blades 70*b* are arranged to shear the members with the third blades 62*a* and the fourth blades 62*b* when the movable blade section 60 is swung.

In the present embodiment, the shape of the fixed blade section 70 is not so complex, so it is made by machining a metal block.

Figure 10:
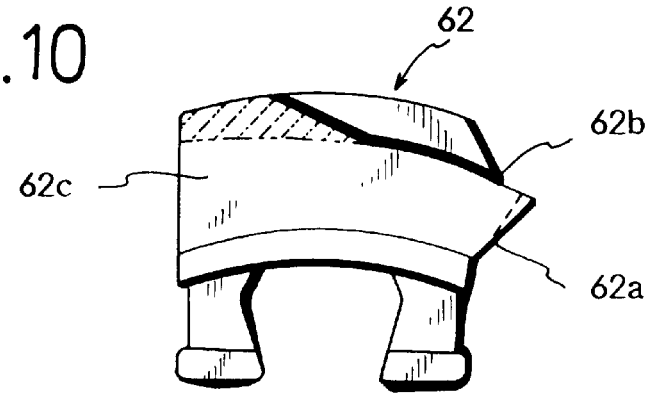
FIG. 10 is a front view of a blade of another example.
Figure 11:
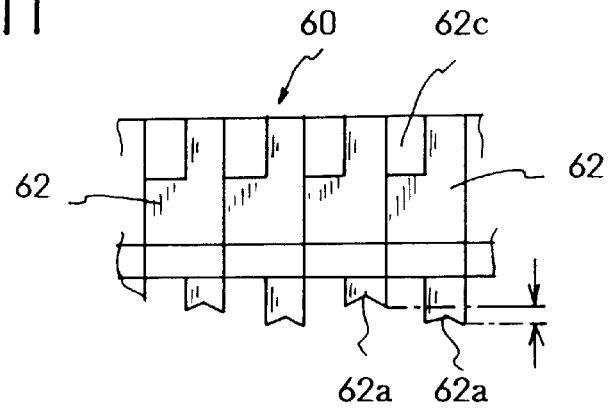
FIG. 11 is a plan view of a movable blade section of another example.

Another example of the blade 62 is shown in FIGS. 10 and 11. The blade 62 prevents the crushed grains from filling in the movable blade section 60 and the fixed blade section 70, and it is capable of securely crushing (shearing) the members. In FIG. 10, the vertical width of a rear section of the groove 62*c* is wider than that of a front section thereof, so that the crushed grains can easily pass the guide hole, which is formed by the groove 62*c* and the adjacent blade 62, towards the rear side. A front chip of the third blade 62*a* is made as a diagonal shape, in which an upper end projects forward, so that the blade 62 can be prevented to move upward. And greater force can be applied to the members to be crushed, so that the members can be securely crushed or sheared.

In the movable blade section 60, a plurality of the blades 62 are arranged side by side in the axial direction of the movable blade section 60. In FIG. 11, two kinds of blades 62, whose length of the third blades 62*a* are different, are arranged side by side. Two kinds of the blades 62 are alternately arranged in FIG. 11, so the primary crushing is executed at two points by the third blades 62*a*. If a plurality of kinds of blades 62 are employed in the movable blade section 60, all the blades do not simultaneously crush or shear the members, so the crushing force applying to the members to be crushed can be greater than that of the case in which all the blades simultaneously crush or shear the members. By the greater crushing force, the members can be more securely crushed into the grains. The grooves 62*c* are seen in FIG. 11 (the plan view) due to the wider grooves 62*c*. A plurality of kinds of blades 62 can be easily made by metal injection molding.

Figure 12:
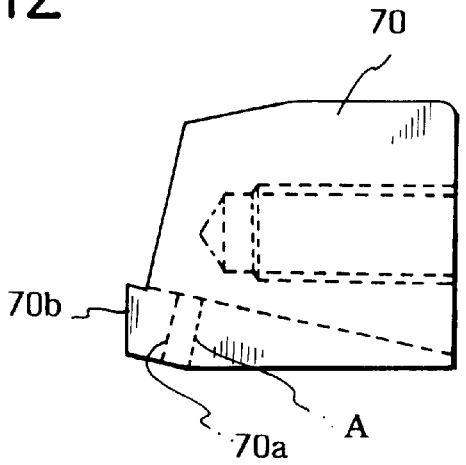
FIG. 12 is a side view of a fixed blade section of another example.

Another example of the fixed blade section 70 is shown in FIG. 12. Front chips of the first blades 70*a* are slightly located forward with respect to that of the first blades shown in FIG. 9, so that the grains, which have been sheared by the first blades 70*a* and the third blades 62*a,* can be easily introduced backward. Note that, in FIG. 12, a position of the front chip of the first blade shown in FIG. 9 is indicated as "A". With this structure, filling the crushed grains in the fixed blade section 70 can be effectively prevented.

The invention may be embodied in other specific forms without departing the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A crusher for crushing members into grains comprising:

a rotary blade section having blades for roughly crushing a member;

a fixed blade section having a plurality of linearly arranged blades;

a movable blade section having a plurality of linearly arranged blades capable of engaging with the blades of said fixed blade section, said movable blade section being capable of swinging to move close to and away from said fixed blade section; and a driving mechanism for swinging said movable blade section with the rotation of said rotary blade section;

wherein crushed members, which have been roughly crushed by said rotary blade section, are adapted to be crushed into grains between said fixed blade section and said movable blade section and wherein blade chips of said rotary blade section are moved along tracks, which are close to engaging portions of the blades of said fixed blade section and said movable blade section, whereby the crushed members, which stay on the engaging portions, can be raked out therefrom by the blades of said rotary blade section.

2. The crusher according to claim 1, wherein said driving mechanism includes:

a motor for rotating said rotary blade section; and a motion converting mechanism for converting the rotary motion of said motor into the swing motion of said movable blade section.

3. The crusher according to claim 2, wherein said movable blade section includes:

a shaft coaxially extending from said movable blade; and a swinging arm being attached to said shaft, and wherein said motion converting mechanism includes:

an eccentric pin being moved along a circular orbit by said motor; and a link connecting said eccentric pin with said swinging arm.

4. The crusher according to claim 1, wherein the blades of said fixed blade section are first blades and second blades, and wherein the blades of said movable blade section are third blades and fourth blades, whereby the crushed members are primarily sheared between the first blades and the third blades, and the crushed members, which have been primarily sheared, are secondly sheared between the second blades and the fourth blades in one stroke of said movable blade section.

5. The crusher according to claim 4, wherein said movable blade section includes:

a columnar blade base; and a plurality of the blades being linearly arranged on an outer circumferential face of said columnar blade base in the axial direction thereof.

6. The crusher according to claim 1, further comprising a body proper formed into a box having an open upper face, wherein side walls of said body proper are formed by: a fixed side plate; a holding member for holding said driving mechanism, said holding member being arranged to face said fixed side plate; and a pair of movable side plates, which can be opened and closed, and which are arranged to face each other, wherein said rotary blade section and said movable blade are pivotably spanned, in parallel, between said fixed side plate and said holding member.

7. The crusher according to claim 5, wherein each blade has the third blade and the fourth blade, and a plurality of the blades are arranged side by side on the blade base.

8. The crusher according to claim 7, wherein a circular guide groove, through which grains sheared by said fixed blade section and said movable blade section pass, it formed on a side face of each blade.

9. The crusher according to claim 7, wherein each blade is made by metal injection molding.

10. A crusher for crushing members into grains comprising:

a rotary blade section having blades for roughly crushing a member;

a fixed blade section having a plurality of linearly arranged blades;

a movable blade section having a plurality of linearly arranged blades capable of engaging with the blades of said fixed blade section, said movable blade section being capable of swinging to move close to and away from said fixed blade section;

a driving mechanism for swinging said movable blade section with the rotation of said rotary blade section; and a body proper formed into a box having an open upper face, wherein side walls of said body proper are formed by: a fixed side plate; a holding member for holding said driving mechanism, said holding member being arranged to face said fixed side plate; and a pair of movable side plates, which can be opened and closed, and which are arranged to face each other;

wherein crushed members, which have been roughly crushed by said rotary blade section, are adapted to be crushed into grains between said fixed blade section and said movable blade section; and wherein said rotary blade section and said movable blade are pivotably spanned, in parallel, between said fixed side plate and said holding member.

11. The crusher according to claim 10, wherein said driving mechanism includes:

a motor for rotating said rotary blade section; and a motion converting mechanism for converting the rotary motion of said motor into the swing motion of said movable blade section.

12. The crusher according to claim 11, wherein said movable blade section includes:

a shaft coaxially extending from said movable blade; and a swinging arm attached to said shaft, and wherein said motion converting mechanism includes:

an eccentric pin being moved along a circular orbit by said motor; and a link connecting said eccentric pin with said swinging arm.

13. The crusher according to claim 10, wherein blade chips of said rotary blade section are moved along tracks, which are close to engaging portions of the blades of said fixed blade section and said movable blade section, whereby the crushed members, which stay on the engaging portions, can be raked out therefrom by the blades of said rotary blade section.

14. The crusher according to claim 10, wherein the blades of said fixed blade section are first blades and second blades; and wherein the blades of said movable blade section are third blades and fourth blades;

whereby the crushed members are primarily sheared between the first blades and the third blades, and the crushed members, which have been primarily sheared, are secondly sheared between the second blades and the fourth blades in one stroke of said movable blade section.

15. The crusher according to claim 14, wherein said movable blade section includes:

a columnar blade base; and a plurality of the blades being linearly arranged on an outer circumferential face of said columnar blade base in the axial direction thereof.

16. The crusher according to claim 15, wherein each blade has the third blade and the fourth blade, and a plurality of the blades are arranged side by side on the blade base.

17. The crusher according to claim 16, wherein a circular guide groove, through which grains sheared by said fixed blade section and said movable blade section pass, is formed on a side face of each blade.

18. The crusher according to claim 16, wherein each blade is made by metal injection molding.

19. A crusher for crushing members into grains comprising:

a rotary blade section having blades for roughly crushing a member;

a fixed blade section having a plurality of linearly arranged blades;

a movable blade section having a plurality of linearly arranged blades capable of engaging with the blades of said fixed blade section, said movable blade section being capable of swinging to move close to and away from said fixed blade section;

a driving mechanism for swinging said movable blade section with the rotation of said rotary blade section;

said blades of said fixed blade section include first blades and second blades;

said blades of said movable blade section include third blades and fourth blades;

wherein the crushed members are primarily sheared between the first blades and the third blades, and the crushed members, which have been primarily sheared, are secondly sheared between the second blades and the fourth blades in one stroke of said movable blade section;

said movable blade section including: a columnar blade base; and a plurality of the blades being linearly arranged on an outer circumferential face of said columnar blade base in the axial direction thereof;

each blade of said movable blade section includes the third blade and the fourth blade, and a plurality of the blades are arranged side by side on the blade base; and a circular guide groove, through which grains sheared by said fixed blade section and said movable blade section pass, is formed on a side face of each blade;

wherein crushed members, which have been roughly crushed by said rotary blade section, are adapted to be crushed into grains between said fixed blade section and said movable blade section.

20. The crusher according to claim 19, wherein said driving mechanism includes:

a motor for rotating said rotary blade section; and a motion converting mechanism for converting the rotary motion of said motor into the swing motion of said movable blade section.

21. The crusher according to claim 20, wherein said movable blade section includes:

a shaft coaxially extending from said movable blade; and a swinging arm being attached to said shaft, and wherein said motion converting mechanism includes:

an eccentric pin being moved along a circular orbit by said motor; and a link connecting said eccentric pin with said swinging arm.

22. The crusher according to claim 19, wherein blade chips of said rotary blade section are moved along tracks, which are close to engaging portions of the blades of said fixed blade section and said movable blade section, whereby the crushed members, which stay on the engaging portions, can be raked out therefrom by the blades of said rotary blade section.

23. The crusher according to claim 19, further comprising a body proper formed into a box having an open upper face, wherein side walls of said body proper are formed by: a fixed side plate; a holding member for holding said driving mechanism, said holding member being arranged to face said fixed side plate; and a pair of movable side plates, which can be opened and closed, and which are arranged to face each other, wherein said rotary blade section and said movable blade are pivotably spanned, in parallel, between said fixed side plate and said holding member.

24. The crusher according to claim 19, wherein each blade is made by metal injection molding.

* * * * *

UNITED STATES PATENT AND TRADEMARK OFFICE

CERTIFICATE OF CORRECTION

PATENT NO. : 5,906,322

DATED : May 25, 1999

INVENTOR(S) : Hama

It is certified that error appears in the above-identified patent and that said Letters Patent is hereby corrected as shown below:

Title page, item

"[54]", please change the title of the invention from

"CRUSHER AND MOVABLE SECTION FOR THE SAME" to

-- CRUSHER AND MOVABLE BLADE SECTION FOR THE SAME --.

Signed and Sealed this

Eighteenth Day of January, 2000

*Attest:*

*Attesting Officer*

Q. TODD DICKINSON

*Commissioner of Patents and Trademarks*